US005958582A

United States Patent [19]

Dunbar et al.

[11] Patent Number: 5,958,582

[45] Date of Patent: Sep. 28, 1999

[54] VERY LOW CREEP, ULTRA HIGH MODULUS, LOW SHRINK, HIGH TENACITY POLYOLEFIN FIBER HAVING GOOD STRENGTH RETENTION AT HIGH TEMPERATURES AND METHOD TO PRODUCE SUCH FIBER

[75] Inventors: James Jay Dunbar, Mechanicsville, Va.; Sheldon Kavesh, Whippany; Dusan Ciril Prevorsek, Morristown, both of N.J.; Thomas Yiu-Tai Tam, Richmond, Va.; Gene Clyde Weedon, Richmond, Va.; Robert Charles Wincklhofer, Richmond, Va.

[73] Assignee: AlliedSignal Inc., Morristown, N.J.

[21] Appl. No.: 09/064,664

[22] Filed: Apr. 20, 1998

Related U.S. Application Data

[62] Division of application No. 08/516,054, Aug. 17, 1995, Pat. No. 5,741,451, which is a division of application No. 08/385,238, Feb. 8, 1995, Pat. No. 5,578,374, which is a continuation of application No. 08/032,774, Mar. 15, 1993, abandoned, which is a continuation of application No. 07/758,913, Sep. 11, 1991, abandoned, which is a continuation of application No. 07/358,471, May 30, 1989, abandoned, which is a continuation of application No. 06/745,164, Jun. 17, 1985, abandoned.

[51] Int. Cl.[6] ..... B32B 3/00

[52] U.S. Cl. ..... 428/364; 428/394; 428/902; 442/181; 442/327

[58] Field of Search ..... 428/364, 902, 428/394; 264/210.7, 210.8, 205, 290.5; 526/348.1; 521/108; 442/181, 327

[56] References Cited

U.S. PATENT DOCUMENTS

| | | |
|---|---|---|
| 3,210,452 | 10/1965 | Cary . |
| 3,377,329 | 4/1968 | Noether et al. . |
| 3,564,835 | 2/1971 | Keefe et al. . |
| 4,268,470 | 5/1981 | Capaccio et al. . |
| 4,413,110 | 11/1983 | Kavesh et al. . |
| 4,617,233 | 10/1986 | Ohta et al. . |
| 4,819,458 | 4/1989 | Kavesh et al. . |
| 5,143,977 | 9/1992 | Yagi et al. . |
| 5,252,394 | 10/1993 | Koune et al. . |
| 5,302,453 | 4/1994 | Koune et al. . |

FOREIGN PATENT DOCUMENTS

| | | |
|---|---|---|
| 006417A1 | 11/1982 | European Pat. Off. . |
| 0110047A2 | 6/1984 | European Pat. Off. . |
| 0139141A2 | 6/1984 | European Pat. Off. . |
| 0135253A1 | 3/1985 | European Pat. Off. . |
| 0213208 | 2/1986 | European Pat. Off. . |
| 020596 A2 | 5/1986 | European Pat. Off. . |
| 0205960B1 | 5/1986 | European Pat. Off. . |
| 0187974A2 | 7/1986 | European Pat. Off. . |
| 52-647/85 | 3/1983 | Japan . |
| 59-216913 | 12/1984 | Japan . |
| 1067142 | 3/1967 | United Kingdom . |
| 183099 | 11/1976 | United Kingdom . |
| 2042414 | 2/1980 | United Kingdom . |

*Primary Examiner*—William Krynski
*Assistant Examiner*—Jim Gray
*Attorney, Agent, or Firm*—Virginia S. Andrews; Melanie L. Brown; Roger H. Criss

[57] ABSTRACT

By poststretching, at a temperature between about 135° and 160° C., a polyethylene fiber, which has already been oriented by drawing at a temperature within 5° C. of its melting point, an ultra high modulus, very low creep, low shrink, high tenacity polyolefin fiber having good strength retention at high temperatures is obtained. The poststretching can be in multiple stages and/or with previous annealing. The poststretching should be done at a draw rate of less than 1 second$^{-1}$. Tensile modulus values over 2,000 g/d for multifilament yarn are consistently obtained for ultrahigh molecular weight polyethylene, with tensile strength values above 30 g/d while at the same time dramatically improving creep (at 160° F. (71.1° C.) and 39,150 psi load) by values at least 25% lower than fiber which has not been poststretched. Shrinkage is improved to values less than 2.5% of the original length when heated from room temperature to 135° C. Performance at higher temperature is improved by about 15° to 25° C.

1 Claim, 2 Drawing Sheets

CREEP OF ULTRA-HIGH MODULUS YARNS
160°F (71.1°C), 39,150 PSI
HIGH MODULUS PRIOR ART FIBER
FIBERS OF THIS INVENTION
OFF LINE
ON LINE
% CREEP
TIME/HRS
0
10
20
30
0
10
20
30
40
50
60
70

VERY LOW CREEP, ULTRA HIGH MODULUS, LOW SHRINK, HIGH TENACITY POLYOLEFIN FIBER HAVING GOOD STRENGTH RETENTION AT HIGH TEMPERATURES AND METHOD TO PRODUCE SUCH FIBER

This is a divisional application of application Ser. No. 08/516,054, filed Aug. 17, 1995 (now U.S. Pat. No. 5,741, 451), which is a divisional of application Ser. No. 08/385, 238, filed Feb. 8, 1995 (now U.S. Pat. No. 5,578,374), which is a continuation of application Ser. No. 08/032,774, filed Mar. 15, 1993 (abandoned), which is a continuation of application Ser. No. 07/758,913 filed Sep. 11, 1991 (abandoned), which is a continuation of application Ser. No. 07/358,471 filed May 30, 1989 (abandoned), which is a continuation of application Ser. No. 06/745,164 filed Jun. 17, 1985 (abandoned).

BACKGROUND OF THE INVENTION

This invention relates to very low creep, ultra high modulus, low shrink, high tenacity polyolefin fiber having good strength retention at high temperatures and the method to produce such fiber. U.S. Pat. No. 4,413,110, herein incorporated by reference, in toto, discloses a prior art fiber and process which could be a precursor process and fiber to be poststretched by the method of this invention to create the fiber of this invention.

Although a tensile strength value of 4.7 GPa (55 g/d) has been reported for a single crystal fibril grown on the surface of a revolving drum from a dilute solution of ultra high molecular weight polyethylene, and separately, a tensile modulus value of 220 GPa (2600 g/d) for single crystal mats of polyethylene grown from dilute solution and subsequently stretched in two stages to about 250 times original; the combination of ultra high modulus and high tenacity with very low creep, low shrinkage and much improved high temperature performance has never before been achieved, especially in a multifilament, solution spun, continuous fiber by a commercially, economically feasible method.

SUMMARY OF THE INVENTION

This invention is a polyolefin shaped article having a creep rate, measured at 160° F. (71.1° C.) and 39,150 psi load, at least one half the value given by the following equation: percent per hour=$1.11\times10^{10}$ $(IV)^{-2.78}$ $(Modulus)^{-2.11}$ where IV is intrinsic viscosity of the article measured in decalin at 135° C., in deciliter per gram, and Modulus is the tensile modulus of the article measured in grams per denier for example by ASTM 885-81, at a 110% per minute strain rate, and at 0 strain. See U.S. Pat. No. 4,436,689, hereby incorporated by reference, in toto, column 4, line 34, for a similar test. Preferably the article is a fiber. Preferably the fiber is a polyolefin. Preferably the polyolefin is polyethylene. Most preferred is a polyethylene fiber.

This invention is also a high strength, high modulus, low creep, high molecular weight polyethylene fiber which has been poststretched to achieve at least about a 10 percent increase in tensile modulus and at least about a 20 percent decrease in creep rate measured at 160° F. and a 39,150 psi load.

Another embodiment of this invention is a high strength, high modulus, low creep, high molecular weight, polyethylene fiber which is poststretched to achieve at least about 20 percent decrease in creep rate measured at 160° F. under 39,150 psi load, and a retention of the same tenacity as the same fiber, before poststretching, at a temperature at least about 15° C. higher. This fiber preferably has a total fiber shrinkage, measured at 135° C., of less than about 2.5 percent. The fiber of the invention also preferably has a tenacity at least about 32 grams per denier when the molecular weight of the fiber is at least 800,000. On the other hand, when the weight average molecular weight of the fiber is at least about 250,000, tenacity is preferred to be at least about 20 grams per denier.

Another embodiment is a high strength, high modulus, low creep, high molecular weight polyethylene fiber which has been poststretched to achieve about 10 percent increase in tensile modulus and a retention of the same tenacity in the same fiber, before poststretching, at a temperature at least about 15° higher.

A further embodiment is a high strength, high modulus, low creep, high shrink, high molecular weight polyethylene poststretched multifilament fiber having any denier for example between about 5 and 1,000,000, weight average molecular weight at least about 800,000, tensile modulus at least about 1,600 grams per denier and total fiber shrinkage loss than 2.5 percent at 135° F. This fiber preferably has a creep of less than 0.48 percent per hour at 160° F., 39,150 psi. When the fiber has been efficiently poststretched the tenacity of the same fiber before it is poststretched is preferably the same at a temperature at least about 25° higher.

The process of this invention is a method to prepare a low creep, high strength, high modulus, high molecular weight polyethylene fiber comprising drawing a highly oriented, high molecular weight polyethylene fiber at a temperature within about 10° C., preferably about 5° C., of its melting temperature then poststretching the fiber at a temperature within about 10° C., preferably about 5° C., of its melting point at a drawing rate of less than 1 $second^{-1}$ and cooling said fiber under tension sufficient to retain its highly oriented state. By melting point is meant the temperature at which the first principal endotherm is seen which is attributable to the major constituent in the fiber, for polyethylene, generally 140° to 151° C. A typical measurement method is found in Example 1. Preferably the fiber is originally formed by solution spinning. The preferably poststretch temperature is between about 140 to 153° C. The preferred method creates a poststretched fiber with an increased modulus of at least 10 percent and at least about 20 percent less creep at 160° F. and 39,150 psi load in the unstretched fiber. It is preferred to maintain tension on the fiber during cooling of the fiber to obtain its highly oriented state. The preferred tension is at least 2 grams per denier. It is preferred to cool the fiber to at least below 90° C., before poststretching.

In the method of this invention it is possible to anneal the fiber after cooling but before poststretching at a temperature between about 110° and 150° C. for a time of at least about 0.2 minutes. Preferred annealing temperature is between about 110° and 150° C. for a time between about 0.2 and 200 minutes. The poststretching method of this invention may be repeated at least once or more.

By drawing rate is meant the drawing velocity difference divided by the length of the drawing zone. For example if fiber or yarn being drawn is fed to the draw zone at a rate of ten meters per inch and withdrawn at a rate of twenty meters per minute; the drawing rate would be (20 m/m-10 m/m) divided by 10 m which equals one $minute^{-1}$ or 0.01667 $second^{-1}$. See U.S. Pat. No. 4,422,993, hereby incorporated by reference, in toto, column 4, lines 26 to 31.

DETAILED DESCRIPTION OF THE INVENTION

Figure 1:
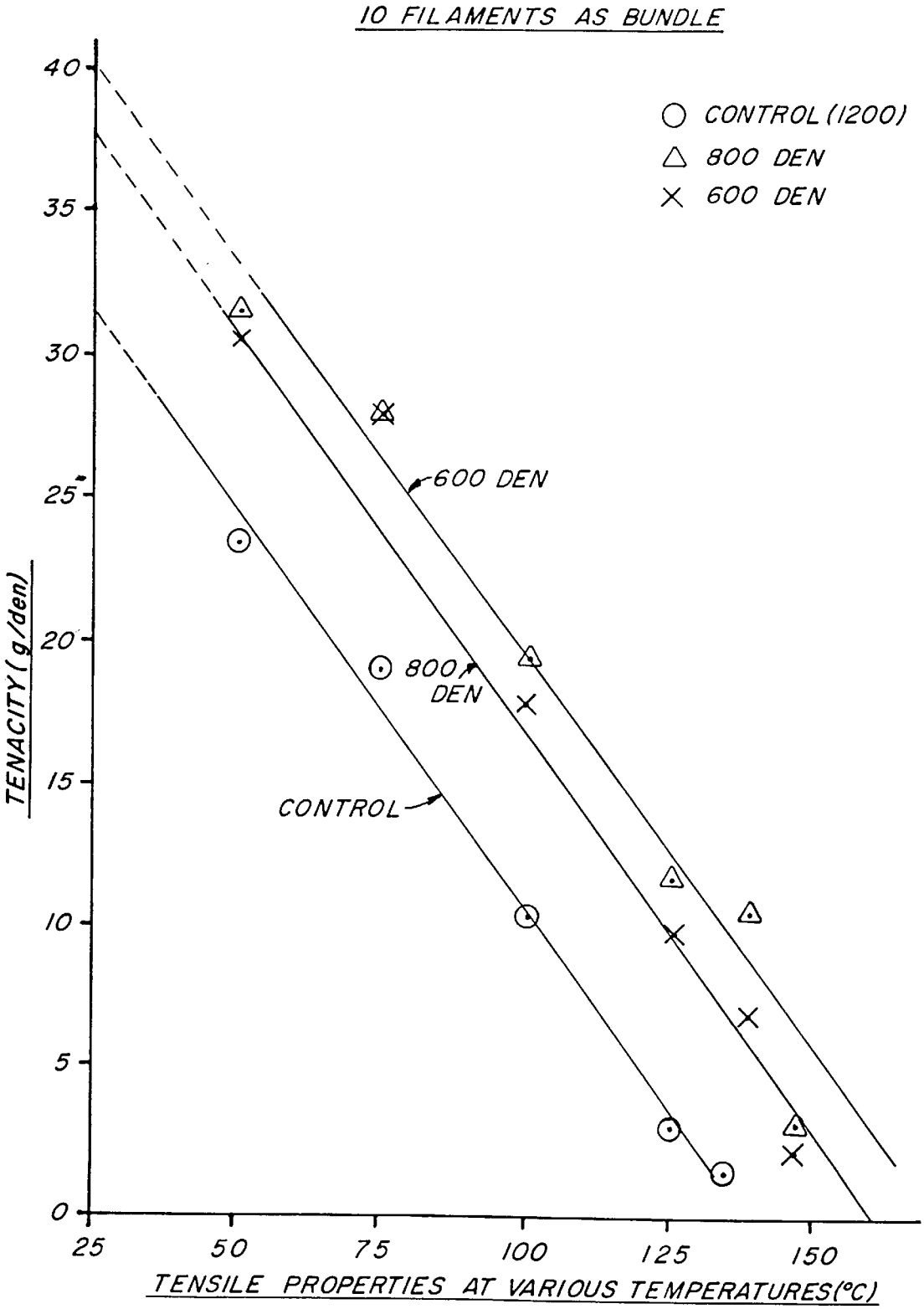
FIG. 1 is a graphic representation of tenacity of a control and yarns of the present invention.

The fiber of this invention is useful in sailcloth, marine cordage, ropes and cables, as reinforcing fibers in thermoplastic or thermosetting resins, elastomers, concrete, sports equipment, boat hulls and spars, various low weight, high performance military and aerospace uses, high performance electrical insulation, randomes, high pressure vessels, hospital equipment and other medical uses, including implants, sutures, and prosthetic devices.

The precursor or feed yarn to be poststretched by the method of this invention can be made by the method of pending U.S. Pat. No. 4,551,296 or U.S. Pat. No. 4,413,110 or by higher speed methods described in the following examples. The feed yarn could also be made by any other published method using a final draw near the melt point, such as in U.S. Pat. No. 4,422,933.

EXAMPLE 1

Preparation of Feed Yarn From Ultra High Viscosity Polyethylene

A 19 filament polyethylene yarn was prepared by the method described in pending U.S. Pat. No. 4,551,296. The starting polymer was of 26 IV (approximately $4\times10^6$ MW). It was dissolved in mineral oil at a concentration of 6 wt. % at a temperature of 240° C. The polymer solution was spun through a 19 filament die of 0.040" hole diameter. The solution filaments were stretched 1.09/l prior to quenching. The resulting gel filaments were stretched 7.06/l at room temperature. The extracted and dried xerogel filaments were stretched 1.2/l at 60° C., 2.8/l at 130° C. and 1.2/l at 150° C. The final take-up speed was 46.2 m/m. This yarn, possessed the following tensile properties:

| | |
|---|---|
| 258 | denier |
| 28.0 | g/d tenacity |
| 982 | g/d modulus |
| 4.1 | elongation |

Measurements of the melting temperatures of the precursor yarn were made by differential scanning calorimetry (DSC) using a Perkin-Elmer DSC-2 with a TADS Data Station. Measurements were made on 3 mg unconstrained samples, in argon at a heating rate of 10° C./min. The DSC measurements showed multiple melting endotherms with the main melting point peak at 146° C., 149° C. and 156° C. in 3 determinations.

EXAMPLE 2

Preparation of Feed Yarn From High Viscosity Polyethylene

A 118 filament yarn was prepared by the method described in U.S. Pat. No. 4,663,707. The starting polymer was of 7.1 IV (approximately 630,000 MW). It was dissolved in mineral oil at a concentration of 8 wt. % at a temperature of 240° C. The polymer solution was spun through a 118 filament die of 0.040" hole diameter. The solution filaments were stretched 8.49/l prior to quenching. The gel filaments were stretched 4.0/l at room temperature. The extracted and dried xerogel filaments were stretched 1.16/l at 50° C., 3.5/l at 120° C. and 1.2/l at 145° C. The final take-up speed was 86.2 m/m. This yarn possessed the following tensile properties:

| | |
|---|---|
| 203 | denier |
| 20.3 | g/d tenacity |
| 782 | g/d modulus |
| 4.6% | elongation |

DSC measurements on this precursor yarn showed a double endotherm with the main melting peak at 143° C. and 144° C. in duplicate determinations.

EXAMPLE 3

Preparation of Feed Yarn From Ultra High Viscosity Polyethylene at Higher Speeds A 118 filament polyethylene yarn was prepared by the method described in U.S. Pat. No. 4,413,110 and Example 1 except stretching of the solvent extracted, dry yarn was done in-line by a multiple stage drawing unit having five conventional large Godet draw rolls with an initial finish applicator roll and a take-up winder which operates at 20 to 500 m/m typically in the middle of this range. However, this rate is a balance of product properties against speed and economics. At lower speeds better yarn properties are achieved, but at higher speeds the cost of the yarn is reduced in lieu of better properties with present know-how. Modifications to the process and apparatus described in U.S. Pat. No. 4,413,110 are described in U.S. Pat. No. 4,284,820.

After the partially oriented yarn containing mineral oil is extracted by trichlorotrifluoroethane (TCTFE) in a washer, it is taken up by a dryer roll to evaporate the solvent. The "dry partially oriented yarn" is then drawn by a multiple stage drawing unit. The following is a detailed example of the drawing process.

Yarn from the washer containing 80% by weight TCTFE is taken up by the first dryer roll at constant speed to insure denier control and to provide first stage drying to about 5% of TCTFE. Drawing between dryer rolls at a temperature of about 110° C.±10 is at 1.05 to 1.8 draw ratio with a tension generally at 4,000±1,000 gms.

A typical coconut oil type finish is applied to the yarn, now containing about 1% by weight TCTFE, as it leaves the second dryer roll, for static control and optimal processing performance. The draw ratio between the second dryer roll at about 60° C. and the first draw roll is kept at a minimum (1.10–1.2 D.R.) because of the cooling effect of the finish. Tension at this stage is generally 5500±1000 gm.

From the first draw roll to the last draw roll maximum draw at each stage is applied. Yarn is drawn between the first drawn roll and the second draw roll (D.R. 1.5 to 2.2) at 130±5° C. with a tension of 6000±1000 gm. In the following stage (second roll and third roll), yarn is drawn at an elevated temperature (140–143° C.±10° C.; D.R. 1.2) with a tension generally of 8000±1000. Between the third roll and fourth or last roll, yarn is drawn at a preferred temperature lower than the previous stage (135 5° C.) at a draw ratio of 1.15 with a tension generally of 8500±1000 gm. The drawn yarn is allowed to cool under tension on the last roll before it is wound onto the winder. The drawn precursor or feed yarn has a denier of 1200, UE (ultimate elongation) 3.7%, UTS (ultimate tension strength) 30 g/den (2.5 GPa) and modulus 1200 gm/den (100 GPa).

EXAMPLE 4

Poststretching

Two precursor yarns were prepared by the method of Example 3 having properties shown in Table I, samples 1 and 4. These precursor feed yarns were cooled under greater than 4 g/d (0.3 GPa) tension to below 80° C. and at the temperature and percent stretch shown as samples 2, 3 and 5 to 9. Samples 2 and 3 were prepared from feed or precursor yarn sample 1 and samples 5 to 9 were prepared from feed yarn 4. Stretching speed was 18 m/m across a 12 m draw zone (3 passes through a 4 m oven). Sample 9 filaments began breaking on completion of the stretching. Tension on the yarn during stretching was between about 8.6 and 11.2 pounds at 140.5° C. and between about 6.3 and 7.7 pounds at 149° C.

EXAMPLE 5

Two-Stage Poststretching

A precursor feed yarn was prepared by the method of Example 3 having properties shown in Table II, Sample 1 and tensilized or stretched in two stages in an oven about 4 m long in four passes of 4 m each per stage (total 16 m) at 149° C. to achieve properties at the stretch percent shown in Table II. Yarn was cooled below 80° C. at tension over 4 g/d after each stretch step. Final take-up was about 20 m/m.

EXAMPLE 6

Two Stage Poststretching of Twisted Feed Yarn

A precursor feed yarn was prepared by the method of Example 3 having properties shown in Table III, Sample 5 and tensilized (stretched) at the conditions and with the resulting properties shown in Table III. Before stretching the yarn was twisted on ¾ twist per inch on a conventional ring twister which lowers the physical properties as can be seen in the feed yarn properties for Sample 5 of Table III. Note that modulus is then nearly doubled by the method of this invention. Final take-up was at about 20 m/m.

EXAMPLE 7

Poststretched Braid

A braid was made in the conventional manner by braiding eight yarns feed (Sample 5 of Table III) yarns together. The braid had the properties given in Table IV, Sample 1 and was stretched under the conditions given in Table IV on a conventional Litzler unit to achieve the properties given in Table IV. Again modulus is about doubled or better, and tenacity increase by about 20–35%.

It is contemplated that the method of poststretching of this invention can also be applied to polyolefin tapes, film and fabric, particularly woven fabric, which have been made from high molecular weight polyolefin and previously oriented. The poststretching could be by biaxial stretching, known in the film orientation art, by use of a center frame, known in the textile art, or monoaxial stretching for tapes. The tape, film or fabric being poststretched should be highly oriented, or constructed of highly oriented fiber, preferably by originally orienting (e.g., drawing) at a higher rate at a temperature near the melting point of the polymer being drawn. The poststretching should be within 5° C. of the melting point of the polyolefin and at drawn rate below 1 second $^{-1}$ in at least one direction.

Creep Values for Examples 4 to 6 Room Temperature Tests

The feed precursor yarn of Example 5, Sample 1, Table II, was used as control yarn, labeled Sample 1 in Table V for creep measurement at room temperature and a load of about 30% breaking strength (UTS). Sample 2, Table V, is a typical yarn made by the method of Example 4 and Sample 3 of Table V is Sample 2 from Table I. Note that creep values of the yarn of this invention are less than 75% or better one-half of the control yarn values at the beginning and improve to less than 25% or better after 53 hours.

Creep Tests at 71° C.

In accelerated tests at 160° F. (71.1° C.) at 10% load the yarns of this invention have even more dramatic improvement in values over control yarn. Creep is further defined at column 15 of U.S. Pat. No. 4,413,110 beginning with line 6. At this temperature the yarns of the invention have only about 10% of the creep of the control values.

In Table VI Sample 1 is Table I, Sample 1, Feed Yarn; Sample 2 is Table I Sample 7, yarn of this invention; as is Sample 3, which is yarn of Sample 8, Table I.

Retention of Properties at Increased Temperatures

FIG. 1 shows a graphic representation of tenacity (UTS) measured at temperatures up to 145° C. for three samples a control and two yarns of this invention, all tested as a bundle of ten filaments. The control yarn is typical of feed yarn, such as Sample 1 Table I. The data and curve labeled 800 denier is typical poststretched yarn, such as Sample 7, Table I and similarly 600 denier is typically two-stage stretched yarn, such as Sample 3, Table II or single stage stretched yearn, such as Sample 2, Table II. Note that 600 denier yarn retains the same tenacity at more than about 30° C. higher temperatures than the prior art control yarn, and the 800 denier yarn retains the same tenacity at more than about 20° C. higher temperatures up to above 135° C.

Shrinkage

Similarly when yarn samples are heated to temperatures up to the melting point the yarn of this invention shows much lower free (unrestrained) shrinkage as shown in Table VII. Free shrinkage is determined by the method of ASTM D 885, section 30.3 using a 9.3 g weight, at temperatures indicated, for one minute. Samples are conditioned, relaxed, for at least 24 hours at 70° F. and 65% relative humidity. The samples are as described above for each denier. The 400 denier sample is typical yarn from two-stage poststretching, such as Sample 5, Table II.

Annealing

Yarns of the present invention were prepared by a process of annealing and poststretching. In one precursor mode the annealing was carried out on the wound package of yarn prior to poststretching. This is "off-line" annealing. In another process the yarn was annealed "in-line" with the poststretching operation by passing the yarn through a two-stage stretch bench with minimal stretch in the first stage and maximum stretch in the second stage.

Ultra High Molecular Weight Yarn

"Off-line" Annealing

A wound roll of yarn from Example 1 described above was placed in a forced convection air oven maintained at a temperature of 120° C. At the end of 15 minutes, the yarn was removed from the oven, cooled to room temperature and fed at a speed of 4 m/min. into a heated stretch zone maintained at 150° C. The yarn was stretched 1.8/1 in traversing the stretch zone. The tensile properties, creep and shrinkage of the annealed and restretched yarn are given in Table VIII. The creep data are also plotted in FIG. 2.

It will be noted that in comparison with the precursor (feed) yarn from Example 1, the annealed and restretched yarn was of 19% higher tenacity and 146% higher modulus. The creep rate at 160° F., 39,150 psi was reduced to one-nineteenth of its initial value and the shrinkage of the yarn at 140° C. was one-fourth of its initial value.

In comparison with the high modulus yarn of the prior art (example 548, U.S. Pat. No. 4,413,110) the annealed and restretched yarn was of 5% higher modulus, the creep rate at 160° F., 39,150 psi was about one-fifth as great (0.15%/hour v. 0.48%/hour) and the shrinkage at 140° C. was lower and more uniform.

"In-line" Annealing

The ultra high molecular weight yarn sample from Example 1 described previously was fed into a two stage stretch bench at a speed of 4 m/minute. The first zone or annealing zone was maintained at a temperature of 120° C. The yarn was stretched 1.17/l in traversing this zone; the minimum tension to keep the yarn moving. The second zone or restretching zone was maintained at a temperature of 150° C. The yarn was stretched 1.95/l in traversing this zone. The tensile properties creep and shrinkage of the in-line annealed and restretched yarn are given in Table VIII. The creep data are also plotted in FIG. 2.

It will be noted that in comparison with the precursor yarn (Example 1) the in-line annealed and restretched yarn was of 22% higher tenacity and 128% higher modulus. The creep rate of 160° F., 39,150 psi was reduced to one-twenty fifth of its initial creep and the shrinkage of the yarn at 140° C. was about one-eight of its initial value.

In comparison with the high modulus yarn of prior art (example 548, U.S. Pat. No. 4,413,110), the in-line annealed and restretched yarn showed one-sixth the creep rate at 160° F., 39,150 psi (0.08%/hour v. 0.48%/hour) and the shrinkage at 140° C. was about one-half as great and more uniform.

High Molecular Weight Yarn—"Off-Line" Annealed

A wound roll of yarn sample from Example 2 described previously was placed in a forced convection air oven maintained at a temperature of 120° C. At the end of 60 minutes the yarn was removed from the oven, cooled to room temperature and fed at a speed of 11.2 m/minutes into a heated stretch zone maintained at 144° C. The yarn was stretched 2.4/l in traversing the stretch zone. The tensile properties, creep and shrinkage of the annealing and restretched yarn and given in Table IX.

It will be seen that in comparison with the precursor yarn from Example 2, the annealed and restretched yarn was of 18% higher tenacity and 92% higher modulus. The creep rate of the annealed and restretched yarn was comparable to the creep rate of a much higher molecular weight yarn prepared without annealing and restretching. Creep rate was 2% of the precursor yarn.

EXAMPLES 8 TO 13

Several 19 filament polyethylene yarns were prepared by the method discussed is pending U.S. Ser. No. 573,607. The starting polymer was of 26 IV (approximately $4\times10^6$ MW). It was dissolved in mineral oil at a concentration of 6 percent by weight at a temperature of 240° C. The polymer solution was spun through a 19 filament die of 0.040" hole diameter. The solution filaments were stretched 1.1/l prior to quenching. The extracted gel filaments were stretched to a maximum degree at room temperature. The dried xerogel filaments were stretched at 1.2/l at 60° C. and to a maximum degree (different for each yarn) at 130° C. and at 150° C. Stretching was at a feed speed of 16 m/m. The tensile properties of these first stretched yarns are given in the first column of Table X.

The first stretched yarns were annealed at constant length for one hour at 120° C. The tensile properties of the annealed yarns are given in the second column of Table X. The annealed yarns were restretched at 150° C. at a feed speed of 4 m/min. The properties of the restretched yarns are given in the last column of Table X. Duplicate entries in the last column indicate the results of two separate stretching experiments.

Examples 9 to 13 are presented in Tables XI to XV.

Thus, the method of the present invention provides the capability of preparing highly stable ultra-high modulus multi-filament yarns using spinning and first stretching conditions which yielded initial yarns of conventional modulus and stability.

DISCUSSION

It is expected that other polyolefins, particularly such as polypropylene, would also have highly improved properties similar to the degree of improvement found with high molecular weight (high viscosity) polyethylene.

The superior properties of the yarn of this invention are obtained when the feed yarn has already been oriented to a considerable degree, such as by drawing or stretching of surface grown fibrils or drawing highly oriented, high molecular weight polyolefin fiber or yarn, preferably polyethylene at a temperature within 5° to 10° C. of its melting point, so that preferably the fiber melt point is above 140°, then this precursor or feed yarn may be preferably cooled under tension or annealed then slowly poststretched (drawn) to the maximum without breaking at a temperature near its melt point (preferably within about 5° C. to 10° C.). The poststretching can be repeated until improvement in yarn properties no longer occurs. The draw or stretch rate of the poststretching should preferably be considerably slower than the final stage of orientation of the feed yarn, by a factor of preferably from about 0.1 to 0.6:1 of the feed yarn draw rate, and at a draw rate of less than 1 $\text{second}^{-1}$.

The ultra high modulus achieved in the yarn of this invention varies by the viscosity (molecular weight) of the polymer of the fiber, denier, the number of filaments and their form. For example, ribbons and tapes, rather than fibers would be expected to achieve only about 1200 g/d (100 GPa), while low denier monofilaments or fibrils could be expected to achieve over about 2,400 g/d. As can seen by comparing the lower viscosity polymer (lower molecular weight) fiber Example 13 with similarly processed higher viscosity polymer (higher molecular weight) fiber which has been drawn even less in poststretching in Example 10, modulus increases with molecular weight. Although mostly due to the amount of poststretching, it can be seen from the Examples that lower denier yarns of this invention exhibit higher tensile properties than do the higher denier poststretched yarns.

U.S. Pat. No. 4,413,110 described yarns of very high modulus. The moduli of examples 543–551 exceeded 1600 g/d and in some cases exceeded 2000 g/d. Example 548 of U.S. Pat. No. 4,413,110 described a 48 filament yarn prepared from 22.6 IV polyethylene (approximately $3.3\times10^6$ Mw) and possessing a modulus of 2305 g/d. This yarn had the highest modulus of the group of examples 543–551.

The elevated temperature creep and shrinkage of this same yarn sample has been measured. Creep was measured at a yarn temperature of 160° F. (71.1° C.) under a sustained load of 39,150 psi. Creep is defined as follows:

$$\%\ \text{creep}=100\times[A(s,t)-A(o)]/A(o)$$

where

A(o) is the length of the test section immediately prior to application of load, s A(s,t) is the length of the test section at time t after application of load, s.

Figure 2:
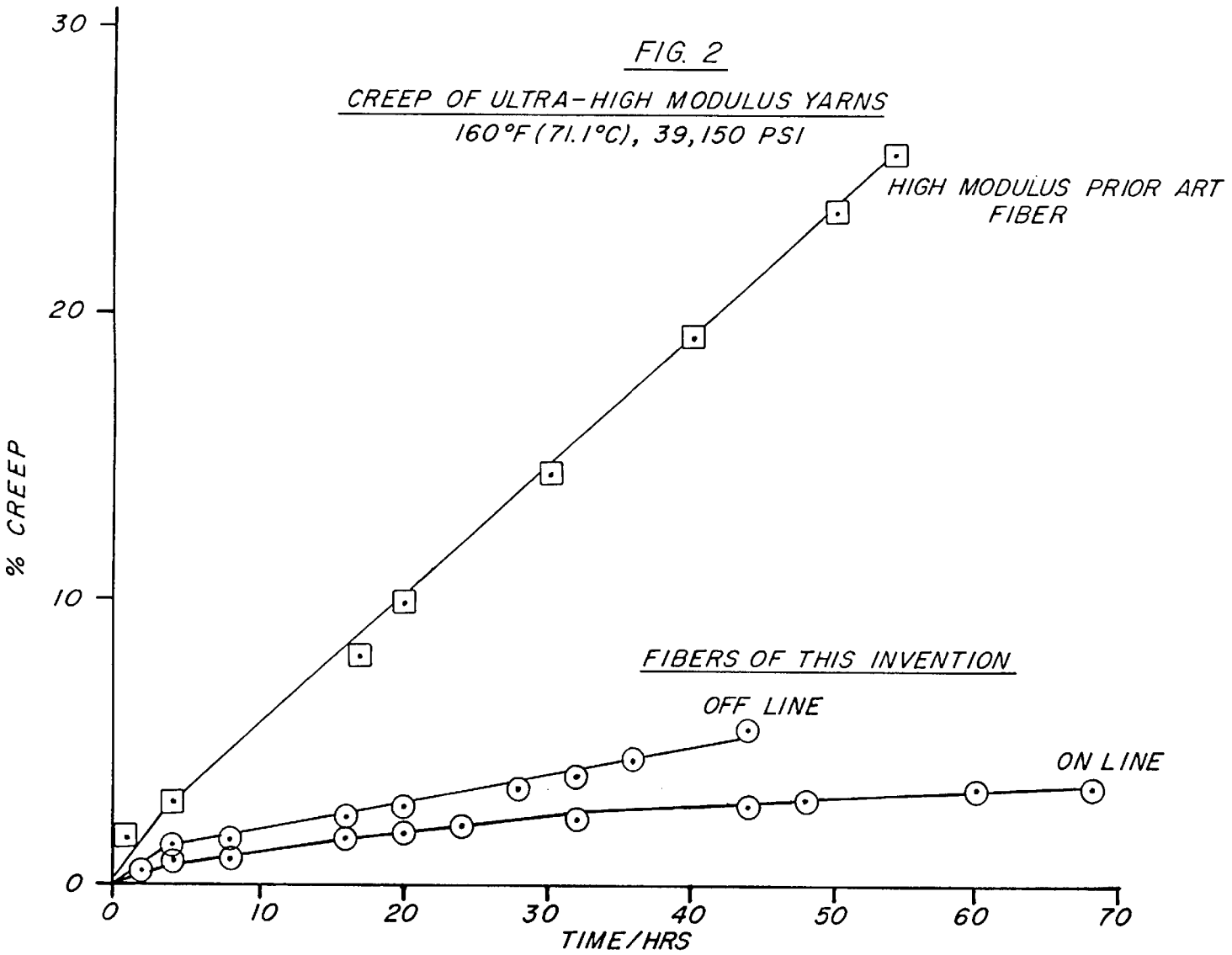
FIG. 2 is a graphic representation of fiber creep data.

Creep measurements on this sample are presented in Table VIII and FIG. 2. It will be noted that creep rate over the first 20 hours of the test averaged 0.48%/hour.

Shrinkage measurements were performed using a Perkin-Elmer TMS-2 thermochemical analyzer in helium, at zero load, at a heating rate of 10° C./minute. Measurements of cumulative shrinkage over the temperature range room temperature to 140° C. were 1.7%, 1.7% and 6.1% in three determinations.

Table XVI presents measurements of fiber viscosity (IV), modulus and creep rate (160° F., 39,150 psi) for prior art fibers including sample 2 which is example 548 of U.S. Pat. No. 4,413,110.

The creep data of Table XVI are well correlated by the following relationship:

$$\text{Creep rate } \%/\text{hr} = 1.11\times10^{10}\ (\text{IV})^{-2.78}\ (\text{modulus})^{-2.11}$$

In fact, as shown in Table XVII the fiber of this invention have observed, measured creep values of about 0.2 to about 0.4 (or considerably less than half) of the prior art fiber creep values, calculated by the above formula.

TABLE I

| Sample | Denier | UE, % | | | Stretch Temp, ° C. | Stretch, % |
|---|---|---|---|---|---|---|
| | | | UTS, g/d | Modulus g/d | | |
| 1 | 1241 | 3.7 | 30.1 | 1458 | (Feed Yarn) | |
| 2 | 856 | 2.9 | 34.5 | 2078 | 140.5 | 45.1 |
| 3 | 627 | 2.8 | 37.8 | 2263 | 149.0 | 120.0 |
| 4 | 1337 | 3.7 | 29.0 | 1419 | (Feed Yarn) | |
| 5 | 889 | 2.8 | 34.9 | 2159 | 140.5 | 45.1 |
| 6 | 882 | 2.8 | 33.9 | 2023 | 140.5 | 50.3 |
| 7 | 807 | 2.7 | 35.9 | 2229 | 140.5 | 60.0 |
| 8 | 770 | 2.7 | 34.9 | 2130 | 140.5 | 70.0 |
| 9 | 700 | 2.7 | 37.4 | 2150 | 140.5 | 80.0 |
| | | | GPa | GPa | | |
| 1 | | | 2.5 | 123 | | |
| 2 | | | 2.9 | 176 | | |
| 3 | | | 3.2 | 192 | | |
| 4 | | | 2.4 | 120 | | |
| 5 | | | 3.0 | 183 | | |
| 6 | | | 2.9 | 171 | | |
| 7 | | | 3.0 | 189 | | |
| 8 | | | 3.0 | 180 | | |
| 9 | | | 3.2 | 182 | | |

TABLE II

| Sample | Denier | UE, % | | | Stretch, % | |
|---|---|---|---|---|---|---|
| | | | | | 1 | 2 |
| | | | UTS, g/d | Modulus g/d | | |
| 1 | 1214 | 3.6 | 30.9 | 1406 | (Feed Yarn) | |
| 2 | 600 | 2.7 | 38.6 | 1953 | 100 | none |
| 3 | 570 | 2.7 | 38.2 | 1928 | 110 | 10 |
| 4 | 511 | 2.7 | 37.6 | 2065 | 110 | 20 |
| 5 | 470 | 2.7 | 40.4 | 2698 | 110 | 30 |

TABLE II-continued

| Sample | Denier | UE, % | | | Stretch, % | |
|---|---|---|---|---|---|---|
| | | | | | 1 | 2 |
| | | | GPa | GPa | | |
| 1 | | | 2.6 | 119 | | |
| 2 | | | 3.3 | 165 | | |
| 3 | | | 3.2 | 163 | | |
| 4 | | | 3.2 | 175 | | |
| 5 | | | 3.4 | 178 | | |

TABLE III

| Sample | Denier | UE, % | | | Yarn Tension, lbs | Stretch Temp | Stretch % |
|---|---|---|---|---|---|---|---|
| | | | UTS, g/d | Modulus, g/d | | | |
| 1 | 827 | 2.6 | 33 | 1991 | 10–13 | 140.5 | 50 |
| 2 | 769 | 2.6 | 35 | 2069 | 10–14 | 140.5 | 60 |
| 3 | 672 | 2.6 | 38 | 2075 | 7.5–10 | 149.5 | 80 |
| 4 | 699 | 2.6 | 36 | 1961 | 7.5–10 | 149.0 | 90 |
| 5 | 1190 | 3.4 | 29 | 1120 | (Feed Yarn) | | |
| | | | GPa | GPa | | | |
| 1 | | | 2.8 | 169 | | | |
| 2 | | | 3.0 | 175 | | | |
| 3 | | | 3.2 | 176 | | | |
| 4 | | | 3.0 | 165 | | | |
| 5 | | | 2.4 | 95 | | | |

TABLE IV

| | | | | | | | |
|---|---|---|---|---|---|---|---|
| | | | g/d | g/d | | | |
| 1 | 9940 | 5.0 | 19.4 | 460 | (Feed Braid) | | |
| 2 | 8522 | 3.6 | 23.2 | 872 | — | 140.5 | 16 |
| 3 | 6942 | 3.2 | 26.8 | 1090 | — | 140.5 | 30 |
| 4 | 6670 | 3.2 | 26.2 | 1134 | — | 140.5 | 33 |
| | | | GPa | GPa | | | |
| 1 | | | 1.6 | 39.0 | | | |
| 2 | | | 1.9 | 73.9 | | | |
| 3 | | | 2.3 | 92.4 | | | |
| 4 | | | 2.2 | 96.1 | | | |

TABLE V

Room Temperature - Creep Measurement

| Identification: | Sample 1 Control from Table II, Sample 1 Feed Yarn | Sample 2 One Stage Poststretch Typical of Example 4 | Sample 3 Poststretched Sample 2 from Table I |
|---|---|---|---|
| Denier | 1214 | 724 | 856 |
| UE, % | 3.6 | 2.6 | 2.9 |
| UTS, | | | |
| g/d | 30.9 | 34.2 | 34.5 |
| GPa | 2.6 | 2.8 | 2.9 |
| Modulus, | | | |
| g/d | 1406 | 2104 | 2078 |
| GPa | 119 | 178 | 176 |
| Load, | | | |
| g/d | 9.27 | 10.26 | 9.27 |

TABLE V-continued

| Room Temperature - Creep Measurement | | | |
|---|---|---|---|
| GPa | 0.78 | 0.87 | 0.78 |
| Creep percent after: | | | |
| 10 minutes | 3.9 | 1.7 | 1.4 |
| 30 minutes | 4.1 | 1.9 | 1.5 |
| 1 hour | 4.3 | 1.8 | 1.5 |
| 3 hours | 4.6 | 1.9 | 1.6 |
| 10.5 hours | 5.4 | 2.2 | 1.9 |
| 19.5 hours | 6.3 | 2.3 | 2.0 |
| 34.5 hours | 8.3 | 2.6 | 2.2 |
| 44.0 hours | 9.7 | 2.8 | 2.3 |
| 53.5 hours | 12.6 | 3.0 | 2.6 |
| 62.2 hours | broke | 3.2 | 2.6 |

| Identification: | Sample 4 Control, Similar to Table II Sample 1 | Sample 5 Poststretched Typical 600 d. yarn | Sample 6 Poststretched Typical 800 d. yarn as in Table I Sample 2 |
|---|---|---|---|
| Denier | 1256 | 512 | 804 |
| UE, % | 3.7 | 3.2 | 3.1 |
| UTS, g/d | 29.3 | 38.2 | 34.1 |
| Modulus, g/d | 1361 | 2355 | 2119 |
| Load, percent of break strength | 30 | 30 | 30 |
| Creep percent after: | | | |
| 10 minutes | 3.5 | 1.80 | 2.7 |
| 30 minutes | 3.1 | 1.94 | 2.8 |
| 1 hour | 3.2 | 2.00 | 2.9 |
| 3 hours | 3.5 | 2.16 | 3.0 |
| 3 days | 7.1 | 3.80 | 4.2 |
| 4 days | 8.2 | 4.31 | 4.5 |
| 5 days | 9.3 | 4.78 | 4.8 |
| 7 days | 11.8 | 5.88 | 5.6 |
| 10 days | 16.0 | 7.84 | 6.9 |
| 11 days | 18.0 | 8.50 | 7.4 |
| 12 days | 19.6 | 9.32 | 7.8 |
| 13 days | 21.4 | 10.00 | 8.2 |
| 14 days | 23.6 | 10.80 | 8.7 |
| 15 days | broke | 13.20 | 10.1 |
| 16 days | — | 14.10 | 10.6 |

TABLE VI

Creep Tests at 10% Load, 71.1° C.

| Identification: | Sample 1 Feed Yarn Table I, Sample 1 | Sample 2 Poststretched Table I, Sample 7 | Sample 3 Poststretch Table I, Sample 8 Test 1 | Sample 3 Poststretch Table I, Sample 8 Retest |
|---|---|---|---|---|
| Denier | 101 | 86 | 100 | 77 |
| Load, g | 315 | 265 | 312 | 240 |
| Creep percent after: hours | | | | |
| 8 | 15 | 1.6 | 2.9 | 2.2 |
| 16 | 26 | 2.5 | 5.2 | 3.8 |
| 24 | 41 | 3.2 | 7.6 | 5.6 |
| 32 | 58 | 3.9 | 10.1 | 7.3 |
| 40 | broke* | 4.5 | 13.3 | 9.6 |
| 48 | | 5.5 | | |
| 56 | | 6.3 | | |
| 64 | | 7.0 | | |

*After 37 hours and after 82.9% creep.

TABLE VII

Free Shrinkage in Percent

| Temperature, ° C. | Sample: Control | 800 Denier | 600 Denier | 400 Denier |
|---|---|---|---|---|
| 50 | 0.059 | 0.05 | 0.054 | 0.043 |
| 75 | 0.096 | 0.09 | 0.098 | 0.086 |
| 100 | 0.135 | 0.25 | 0.21 | 0.18 |
| 125 | 0.3 | 0.43 | 0.48 | 0.36 |
| 135 | 2.9, 3.4 | 1.4, 1.9 | 0.8, 0.9 | — |
| 140 | 5.1 | 2.1 | 1.2 | — |
| 145 | 22.5, 21.1 | 16.6, 18.0 | 3.2, 7.5 | 1.2, 1.1 |

TABLE VIII

Properties of Ultra High Modulus Yarns from Ultra High Molecular Weight Yarns

| | Tenacity, g/d | Modulus, g/d | Creep Rate, %/hr* | Percent Shrinkage at 140° C.** |
|---|---|---|---|---|
| Best Prior Art (U.S. Pat. No. 4 413 110) Example 548 | 32.0 | 2305 | 0.48 | 1.7, 1.7, 6.1 |
| Precursor Yarn Sample from Example 1 | 28.0 | 982 | 2.0 | 5.4, 7.7 |
| Yarns of This Invention | | | | |
| Off-line Annealed | 33.4 | 2411 | 0.105 | 1.4, 1.7 |
| In-line Annealed | 34.1 | 2240 | 0.08 | 0.7, 1.0 |

*At 160° F. (71.1° C.), 39, 150 psi
**Cumulative shrinkage between room temperature and 140° C.

TABLE IX

Properties of Ultra High Modulus Yarns - High Molecular Weight (7 IV)

| | Tenacity, g/d | Modulus, g/d | Creep Rate, %/Hr* | Percent Shrinkage at 140° C.** |
|---|---|---|---|---|
| Precursor Yarn Sample from Example 2 | 20.3 | 782 | 120 | — |
| Yarn of This Invention Off-line Annealed | 23.9 | 1500 | 2.4 | 16.8, 17.8 |

*At 160° F. (71.1° C.), 39, 150 psi
**Cumulative shrinkage between room temperature and 140° C.

TABLE X

Example 8

| | After First Stretch | Annealed 1 hr at 120° C. | After Restretch at 150° C. |
|---|---|---|---|
| Sample 1 | | | |
| Denier | 176 | 159 | 103, 99, 100 |
| Tenacity, g/d | 25.3 | 23.8 | 27.5, 36.6, 29.0 |
| Modulus, g/d | 1538 | 1415 | 2306, 2250, 2060 |
| UE, % | 2.6 | 2.4 | 1.8, 2.3, 2.2 |

TABLE X-continued

| | Example 8 | | |
|---|---|---|---|
| | After First Stretch | Annealed 1 hr at 120° C. | After Restretch at 150° C. |
| Sample 2 | | | |
| Denier | 199 | 191 | 104, 131 |
| Tenacity, g/d | 29.5 | 25.2 | 22.4, 25.1 |
| Modulus, g/d | 1308 | 1272 | 2370, 1960 |
| UE, % | 3.2 | 2.9 | 1.7, 2.0 |
| Sample 3 | | | |
| Denier | 212 | 197 | 147 |
| Tenacity, g/d | 26.0 | 25.0 | 29.0 |
| Modulus, g/d | 1331 | 1243 | 1904 |
| UE, % | 3.0 | 2.8 | 2.4 |
| Sample 4 | | | |
| Denier | 1021 | 941 | 656, 536 |
| Tenacity, g/d | 30.4 | 29.3 | 35.3, 35.0 |
| Modulus, g/d | 1202 | 1194 | 1460, 1532 |
| UE, % | 3.9 | 3.6 | 3.1, 3.1 |
| Sample 5 | | | |
| Denier | 975 | 1009 | 529 |
| Tenacity, g/d | 30.1 | 295 | 36.6 |
| Modulus, g/d | 1236 | 1229 | 1611 |
| UE, % | 3.8 | 3.7 | 3.2 |

TABLE XI

Annealing/Restretching Studies
Example 9
Feed: as in Example 8, 19 FILS, 26 IV, 236 denier, 29.7 g/d tenacity, 1057 g/d modulus, 4.3% UE Restretched at 150° C. with no annealing

| Sample No. | Feed Speed, m/min | Stretch Ratio at 150° C. | Denier | UTS Tenacity, g/d | Modulus, g/d | UE, % |
|---|---|---|---|---|---|---|
| 1 | 4 | 1.5 | 128 | 30.8 | 1754 | 2.6 |
| 2 | 8 | 1.5 | 156 | 28.6 | 1786 | 2.4 |
| 3 | 16 | 1.3 | 177 | 27.8 | 1479 | 2.7 |

Restretched at 120° C. and 150° C.

| Sample No. | Feed Speed, m/min | Stretch Ratio 120° C. | Stretch Ratio 150° C. | Denier | UTS Tenacity, g/d | Modulus, g/d | UE, % |
|---|---|---|---|---|---|---|---|
| 4 | 4 | 1.15 | 1.5 | 158 | 30.6 | 1729 | 2.8 |
| 5 | 8 | 1.13 | 1.27 | 192 | 32.8 | 1474 | 3.2 |
| 6 | 16 | 1.18 | 1.3 | 187 | 29.3 | 1462 | 3.0 |

Annealed 1 hour at 120° C., Restretched at 150° C.

| Sample No. | Feed Speed, m/min | Stretch Ratio at 150° C. | Denier | UTS Tenacity, g/d | Modulus, g/d | UE, % |
|---|---|---|---|---|---|---|
| 7 | 4 | 1.8 | 131 | 32.4 | 1975 | 2.3 |
| 8 | 8 | 1.35 | 169 | 31.2 | 1625 | 2.6 |
| 9 | 16 | 1.3 | 165 | 29.3 | 1405 | 3.0 |

TABLE XII

Annealing/Restretching Studies
Example 10
Feed: as in Example 8, 19 FILS, 26 IV, 258 denier, 28.0 g/d tenacity, 982 g/d modulus, 4.1% UE Annealed in-line

| Sample No. | Feed Speed, m/min | Stretch Ratio at T. | Stretch Ratio 150° C. | Denier | Tenacity, g/d | Modulus, g/d | UE, % |
|---|---|---|---|---|---|---|---|
| Annealed in-line at 120° C. | | | | | | | |
| 1 | 4 | 1.17 | 1.95 | 114 | 34.1 | 2240 | 2.2 |
| 2 | 8 | 1.18 | 1.6 | 148 | 33.0 | 1994 | 2.6 |
| Annealed in-line at 127° C. | | | | | | | |
| 3 | 4 | 1.18 | 1.75 | 124 | 33.0 | 2070 | 2.6 |
| 4 | 8 | 1.17 | 1.3 | 173 | 32.0 | 1688 | 2.6 |
| Annealed in-line at 135° C. | | | | | | | |
| 5 | 4 | 1.17 | 1.86 | 129 | 36.0 | 2210 | 2.4 |
| 6 | 8 | 1.17 | 1.5 | 151 | 31.9 | 2044 | 2.4 |

Annealed off-line (restretched at 4 m/min)

| Sample No. | Annealed Temp, °C. | Annealed Time, min | Stretch Ratio at 150° C. | Denier | Tenacity, g/d | Modulus, g/d | UE, % |
|---|---|---|---|---|---|---|---|
| 1 | 120 | 15 | 1.8 | 102 | 33.4 | 2411 | 2.3 |
| 2 | 120 | 30 | 1.9 | 97 | 29.2 | 2209 | 2.2 |
| 3 | 120 | 60 | 1.8 | 109 | 32.6 | 2243 | 2.4 |
| 1 | 130 | 15 | 1.8 | 111 | 32.4 | 2256 | 2.4 |
| 2 | 130 | 30 | 1.7 | 125 | 32.5 | 2200 | 2.1 |
| 3 | 130 | 60 | 1.5 | 136 | 28.9 | 1927 | 2.7 |

TABLE XIII

Annealing/Restretching Study
Example 11
Feed: similar to Example 2 but: 118 FILS, 26 IV, 1120 denier, 30.0 g/d tenacity, 1103 g/d modulus
Annealed in-line, 3 passes × 3 meters, restretched at 150° C., restretched at 8 m/min feed speed

| Sample No. | T., ° C. | Stretch Ratio at T. | Stretch Ratio at 150° C. | Tension, lbs No.1 | Tension, lbs No.2 |
|---|---|---|---|---|---|
| Hot Feed Roll | | | | | |
| 1 | 149 | 1.02 | 1.45 | 0.98 | 0.54 |
| 2 | 151 | 1.65 | 1.27 | 3.08 | 0.92 |
| 3 | 151 | 1.33 | 1.32 | — | — |
| 4 | 140 | 0.96 | 1.6 | 1.02 | 0.72 |
| 5 | 140 | 1.25 | 1.35 | 4.42 | 0.84 |
| 6 | 140 | 1.10 | 1.41 | 3.50 | 1.10 |
| 7 | 131 | 0.99 | 1.48 | 1.94 | 0.82 |
| 8 | 130 | 1.37 | 1.30 | 9.58 | 1.00 |
| 9 | 130 | 1.16 | 1.39 | 8.68 | 0.92 |

| Sample No. | Denier | UTS Tenacity, g/d | Modulus, g/d | UE, % |
|---|---|---|---|---|
| Hot Feed Roll | | | | |
| 1 | 662 | 33.1 | 1730 | 3.0 |
| 2 | 490 | 36.4 | 1801 | 2.8 |
| 3 | 654 | 34.3 | 1801 | 2.9 |
| 4 | 742 | 32.0 | 1422 | 3.3 |
| 5 | 588 | 35.5 | 1901 | 2.8 |
| 6 | 699 | 34.1 | 1750 | 3.0 |

TABLE XIII-continued

Annealing/Restretching Study
Example 11
Feed: similar to Example 2 but: 118 FILS, 26 IV, 1120 denier, 30.0 g/d tenacity, 1103 g/d modulus
Annealed in-line, 3 passes × 3 meters, restretched at 150° C., restretched at 8 m/min feed speed

| | | | | |
|---|---|---|---|---|
| 7 | 706 | 31.8 | 1501 | 3.1 |
| 8 | 667 | 33.9 | 1744 | 2.8 |
| 9 | 708 | 33.6 | 1603 | 3.1 |

Cold Feed Roll

| Sample | | Stretch Ratio | | Tension, lbs | |
|---|---|---|---|---|---|
| No. | T., ° C. | at T. | at 150° C. | No.1 | No.2 |
| 10 | 150 | 0.94 | 1.50 | 0.7 | 0.72 |
| 11 | 149 | 1.11 | 1.42 | 2.04 | 0.76 |
| 12 | 150 | 1.31 | 1.30 | 3.36 | 0.44 |
| 13 | 150 | 1.50 | 1.25 | 4.12 | 0.56 |
| 14 | 150 | 1.66 | 1.18 | 4.68 | 0.24 |
| | 150 | 1.84(broke) | 1.16 | — | — |
| 15 | 140 | 1.03 | 1.45 | — | — |
| 16 | 140 | 1.48 | 1.25 | 4.46 | 1.00 |
| 17 | 130 | 1.06 | 1.53 | 1.15 | — |
| 18 | 130 | 1.43 | 1.22 | 7.94 | 1.24 |
| 19 | 120 | 0.96 | 1.65 | 0.86 | — |
| 20 | 120 | 1.07 | 1.40 | 5.86 | 0.94 |

| Sample No. | Denier | UTS Tenacity, g/d | Modulus, g/d | UE, % |
|---|---|---|---|---|
| 10 | 685 | 34.2 | 1606 | 3.2 |
| 11 | 724 | 33.4 | 1677 | 3.1 |
| 12 | 609 | 34.1 | 1907 | 2.7 |
| 13 | 613 | 35.2 | 1951 | 2.7 |
| 14 | 514 | 35.6 | 2003 | 2.6 |
| 15 | 741 | 33.6 | 1545 | 3.3 |
| 16 | 641 | 35.8 | 1871 | 2.8 |
| 17 | 640 | 31.8 | 1391 | 3.1 |
| 18 | 669 | 33.6 | 1813 | 2.8 |
| 19 | 707 | 29.6 | 1252 | 3.2 |
| 20 | 694 | 33.1 | 1690 | 3.0 |

Annealed 15 min at 120° C.

| Sample | | Stretch Ratio | | Tension, lbs | |
|---|---|---|---|---|---|
| No. | T., ° C. | at T. | at 150° C. | No.1 | No.2 |
| 21(outside) | 150 | 1.61 | 1.21 | — | — |
| 22(inside) | — | — | — | — | — |

| Sample No. | Denier | UTS Tenacity, g/d | Modulus, g/d | UE, % |
|---|---|---|---|---|
| 21(outside) | 538 | 36.8 | 2062 | 2.6 |
| 22(inside) | 562 | 35.2 | 1835 | 2.7 |

TABLE XIV

Annealing/Restretching Study
Example 12
Annealed on roll 1 hour at 120° C. restretched in two stages at 150° C. - (restretch feed speed = 8 m/min)

| Sample | Stretch Ratio | | | Tenacity, | Modulus, | UE, |
|---|---|---|---|---|---|---|
| No. | No. 1 | No. 2 | Denier | g/d | g/d | % |
| 1 | Control | | 1074 | 31.2 | 1329 | — |
| 2 | 1.65 | 1.21 | 567 | 38.5 | 1948 | 2.8 |
| 3 | 1.62 | 1.18 | 546 | 39.7 | 2005 | 2.6 |

TABLE XIV-continued

Annealing/Restretching Study
Example 12
Annealed on roll 1 hour at 120° C. restretched in two stages at 150° C. - (restretch feed speed = 8 m/min)

| Sample | Stretch Ratio | | | Tenacity, | Modulus, | UE, |
|---|---|---|---|---|---|---|
| No. | No. 1 | No. 2 | Denier | g/d | g/d | % |
| 4 | Control | | 1284 | 30.0 | 1309 | 3.6 |
| 5 | 1.66 | 1.21 | 717 | 35.8 | 1818 | 2.7 |
| 6 | 1.65 | 1.16 | 668 | 37.3 | 1797 | 2.8 |
| 7 | 1.63 | 1.17 | 683 | 37.3 | 1904 | 2.8 |
| 8 | 1.62 | 1.14 | 713 | 36.6 | 1851 | 2.8 |
| 9 | 1.62 | 1.15 | 700 | 37.0 | 1922 | 2.8 |
| 10 | Control | | 1353 | 29.0 | 1167 | 3.7 |
| 11 | 1.61 | 1.14 | 660 | 36.6 | 1949 | 2.7 |
| 12 | 1.62 | 1.16 | 752 | 36.2 | 1761 | 2.9 |

TABLE XV

Restretching of 7 IV Yarns from Example 2
Example 13
118 FILS

| Annealing Time at 120° C. | Restretch Ratio at 144° C. | Denier | Tenacity, g/d | Modulus, g/d | UE, % |
|---|---|---|---|---|---|
| Control | | 347 | 20.5 | 710 | 4.9 |
| 0 | 2.2 | 140 | 21.4 | 1320 | 2.4 |
| 0 | 2.4 | 140 | 22.3 | 1240 | 2.7 |
| 0 | 2.75 | 133 | 23.0 | 1260 | 2.6 |
| Control | | 203 | 20.3 | 780 | 4.7 |
| 60 minutes | 2.2 | 148 | 22.8 | 1280 | 2.8 |
| 60 minutes | 2.4 | 112 | 23.9 | 1500 | 2.6 |
| 60 minutes | 2.75 | 116 | 22.4 | 1500 | 2.4 |
| 60 minutes | 2.88 (broke) | 75 | 22.1 | 1670 | 1.9 |

TABLE XVI

Prior Art Fibers

| Sample | Fiber Viscosity | Modulus | Creep Rate at 160° F., 39,150 psi, %/hr | |
|---|---|---|---|---|
| No. | (IV) dl/g | g/d | Observed | Calculated* |
| 1 | 6.5 | 782 | 44 | 48 |
| | | | 54 | 48 |
| 2 | 13.9 | 2305 | 0.48 | 0.60 |
| 3 | 15.8 | 1458 | 1.8 | 1.1 |
| 4 | 16.9 | 982 | 1.6 | 2.1 |

*Creep Rate = $1.1144 \times 10^{10}$ $(IV)^{-2.7778}$ $(Modulus)^{-2.1096}$

TABLE XVII

Fibers of the Invention

| Sample | Fiber Viscosity | Modulus | Creep Rate at 160° F. 39,150 psi, %/hr | | |
|---|---|---|---|---|---|
| No. | (IV) dl/g | g/d | Observed | Calculated* | Obs/Calc |
| 1 | 6.5 | 1500 | 2.4 | 12.6 | 0.19 |
| 2 | 14.6 | 2129 | 0.10 | 0.62 | 0.16 |
| 3 | 16.9 | 2411 | 0.10 | 0.32 | 0.31 |

TABLE XVII-continued

| Fibers of the Invention | | | | | |
|---|---|---|---|---|---|
| Sample | Fiber Viscosity | Modulus | Creep Rate at 160° F. 39,150 psi, %/hr | | |
| No. | (IV) dl/g | g/d | Observed | Calculated* | Obs/Calc |
| 4 | 16.9 | 2204 | 0.08 | 0.38 | 0.21 |
| 5 | 17.9 | 2160 | 0.14 | 0.34 | 0.41 |

*Calculated from relationship for prior art fibers
Creep Rate = $1.11 \times 10^{10}$ $(IV)^{-2.8}$ $(Modulus)^{-2.1}$

We claim:

1. A low creep, high modulus, high strength, low shrink, high molecular weight polyolefin shaped article or fabric having improved strength retention at high temperatures which has been prepared by poststretching at a drawing rate of less than about 1 $second^{-1}$ at a temperature within about 10° C. of its melting temperature, said shaped article or fabric, prior to being poststretched, being fabricated from polyolefin which has been highly oriented at a higher rate than 1 $second^{-1}$ and at a temperature of within about 10° C. of its melting point.

* * * * *